US006195049B1

(12) United States Patent
Kim et al.

(10) Patent No.: US 6,195,049 B1
(45) Date of Patent: Feb. 27, 2001

(54) MICRO-STRIP PATCH ANTENNA FOR TRANSCEIVER

(75) Inventors: Young-eil Kim; Duck-su Kim; Sung-soo Lee, all of Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/393,305

(22) Filed: Sep. 10, 1999

(30) Foreign Application Priority Data

Sep. 11, 1998 (KR) ..... 98-37529

(51) Int. Cl.[7] ..... H01Q 1/38

(52) U.S. Cl. ..... 343/700 MS; 343/702; 343/846

(58) Field of Search ..... 343/700 MS, 702, 343/845, 895, 846, 848; H01Q 1/38

(56) References Cited

U.S. PATENT DOCUMENTS 5,861,854 * 1/1999 Kawahata et al. ..... 343/702
5,909,198 * 6/1999 Mandai et al. ..... 343/895
5,969,680 * 10/1999 Tsurn et al. ..... 343/700 MS
5,977,915 * 11/1999 Bergstedt et al. ..... 343/700 MS
6,061,025 * 5/2000 Jackson et al. ..... 343/700 MS

* cited by examiner

*Primary Examiner*—Hoanganh Le
*Assistant Examiner*—Shih-Chao Chen
(74) *Attorney, Agent, or Firm*—Sughrue, Mion, Zinn, Macpeak & Seas, PLLC

(57) ABSTRACT

A micro-strip patch antenna for a radiotelephone transceiver includes a dielectric ceramic module for transmission and reception having a first ground plate, just one dielectric ceramic part for synchronizing frequencies, a conductive patch on the dielectric ceramic part for transmitting and receiving electromagnetic waves, transmission and reception power supply terminals projecting from different sides of the conductive patch. The antenna also has printed circuit board having a base, a second ground plate on the base to contact the first, and strip lines formed on the base so as to be adjacent but spaced from to the ground plates. The strip lines take care of impedance matching, and antenna provides for the use of a single channel power supply without modification.

10 Claims, 3 Drawing Sheets

MICRO-STRIP PATCH ANTENNA FOR TRANSCEIVER

BACKGROUND OF THE INVENTION

1. Field of the Invention

The present invention relates to a micro-strip patch antenna for a radiotelephone transceiver.

2. Description of the Related Art

Mobile radio terminals, such as portable radiotelephones, are getting smaller and lighter. In wireless communications, the antenna has a great influence on the performance of the radiotelephone. The antenna is the interface between the radiotelephone and free space. Since most "regular-sized" antennas exhibit close-to-theoretical performance when outside influence is not significant, they typically can easily be designed. Small antennas, however, have low radiation efficiency and a narrow frequency bandwidth. In addition, since a current may be induced in the radiotelephone body by electromagnetic interaction between antenna elements and the radiotelephone body, an electromagnetic wave may be radiated in an unexpected direction.

The types of linear antennas generally used in portable radiotelephones are the $\lambda/2$ monopole antenna (the length of which is set to half of the wavelength of the electromagnetic wave employed), a $\lambda/4$ monopole antenna (an improved version of the $\lambda/2$ monopole antenna), and a $\lambda/2$ whip antenna. These antennas have a length of 16 or 8 cm when the employed frequency is 900 MHz or 1.9 GHz, respectively, and can be enclosed in the radiotelephone body.

When the 900 MHz band is assigned as the frequency for radiotelephone communication, however, the length of the antenna must be 16 cm so as to receive the electromagnetic wave with the $\lambda/2$ monopole antenna.

Since the length of the above monopole antennas is relatively long, as depicted in FIG. 1, a radiotelephone using a monopole antenna as described above must use an external antenna 3 which projects outward from the radiotelephone body 1.

In a radiotelephone having such an external antenna, as illustrated in an RF (radio frequency) characteristic curve shown in FIG. 2, it is difficult to attain the maximum gain at the upper and lower limit frequencies actually containing receiving (Rx) and transmitting (Tx) communication signals. Therefore, when the bandwidth is set to be wide (so as to attain the maximum gain), there arises a problem in that noise tends to interfere with the signal wave easily. Further, the monopole type external antenna is an element that severely limits the freedom of the designer in designing the radiotelephone.

A known alternative to the monopole type external antenna is the general micro-strip patch antenna. The general micro-strip patch antenna, although more compact, has several drawbacks, as will now be described.

A general micro-strip patch antenna may use a dielectric ceramic, but requires two dielectric ceramic element parts for transmitting and receiving signals when the transmission and reception bandwidths are different from each other (as is usually the case with portable radiotelephones).

FIG. 3 shows a conventional internal antenna with a transmitting patch 30, a transmitting dielectric ceramic 32, a common ground 34, a receiving dielectric ceramic 36, and a receiving patch 38. In a radiotelephone having separate transmitting and receiving frequency bandwidths, the two dielectric antennas, which respectively perform the transmitting and receiving functions, are bonded to each other with the transmitting and receiving patches 30 and 38 facing outward.

Thus, such an antenna really is two dielectric antennas (one for transmission and one for reception), and it is difficult to reduce the size of a portable radiotelephone using such a general micro-strip antenna.

There are other problems with the general micro-strip antenna. For one thing, the supplying of power from what is typically a sole power supply point to the dielectric antennas is difficult, and it is also difficult to draw a common ground line. Further, the unit price of this type of antenna is high, and they are heavy enough to contribute significantly to the total weight of a radiotelephone. Furthermore, since the power to the antennas is normally supplied through only one channel, there is a disadvantage in that the main circuit of the radiotelephone must be altered because of the use of two antennas.

SUMMARY OF THE INVENTION

To solve the above and other problems, it is an objective of the present invention to provide a single micro-strip patch antenna for a portable radiotelephone transceiver which is internal, compact, capable of transmission and reception with only one dielectric ceramic part, and yet operable with separate transmission and reception frequency bandwidths by virtue of matching the antenna impedance to a main circuit impedance, and by supplying power to two frequency bandwidth terminals from one power supply source using strip lines on a printed circuit board.

Accordingly, to achieve the above objective, there is provided a micro-strip patch antenna for a radiotelephone transceiver including: a dielectric ceramic module for transmission and reception having a first ground plate, a dielectric ceramic mounted on the first ground plate for synchronizing frequencies, a conductive patch mounted on the dielectric ceramic for transmitting and receiving electromagnetic waves, a transmission power supply terminal formed to project from one side of the conductive patch to supply power for transmission, and a reception power supply terminal formed to project from another side of the conductive patch to supply power for reception; and a printed circuit board having a base, a second ground plate mounted on the base to contact the first ground plate, and strip lines formed on the base to be adjacent to the first ground plate and connected to the transmission and reception power supply terminals.

BRIEF DESCRIPTION OF THE DRAWING FIGURES

The above and other advantages of the present invention will become more is apparent by taking the below description of an embodiment of the invention together with reference to the attached drawings in which.

DESCRIPTION OF THE PREFERRED EMBODIMENT

Figure 1:
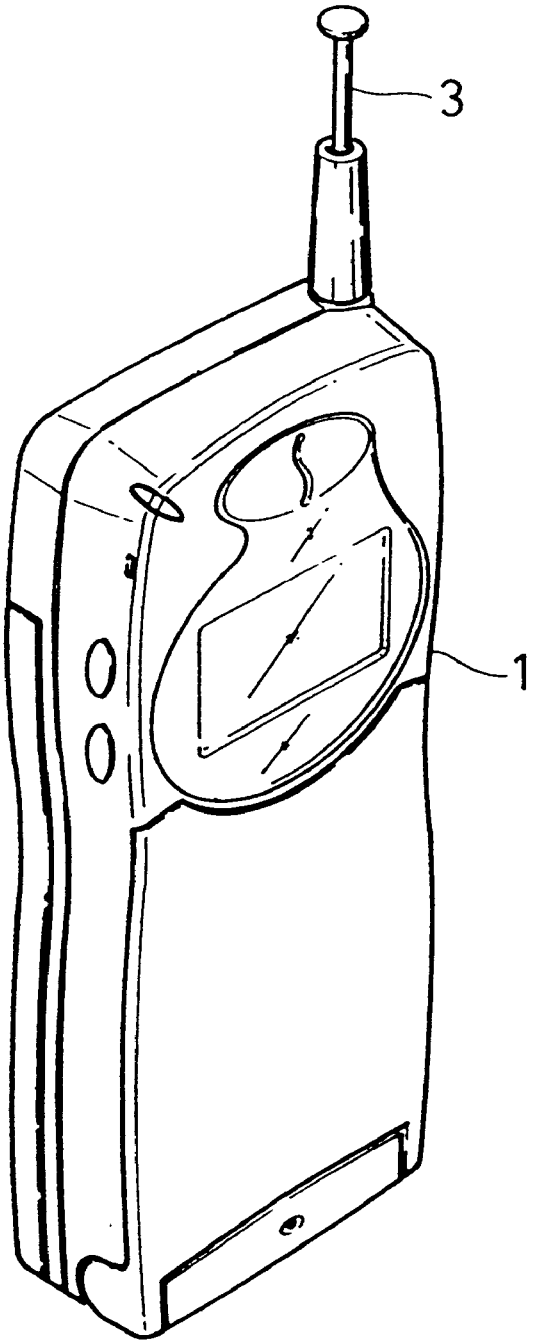
FIG. 1 (PRIOR ART)
FIG. 1 is a schematic perspective view illustrating a radiotelephone having a conventional external antenna.
Figure 2:
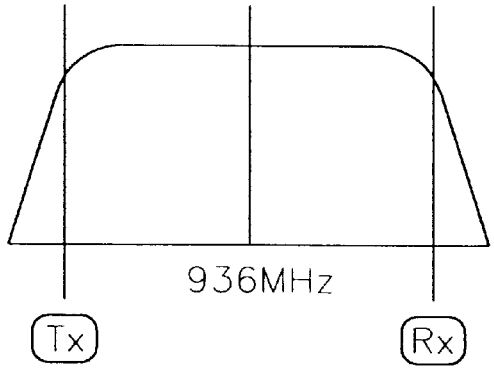
FIG. 2 (PRIOR ART)
FIG. 2 is a graph illustrating frequency characteristics of the antenna shown in FIG. 1.
Figure 3:
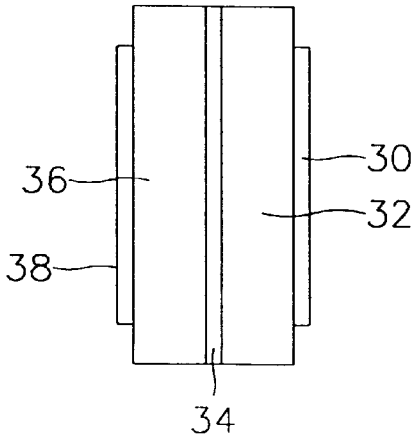
FIG. 3 (PRIOR ART)
FIG. 3 is a side view illustrating a conventional internal antenna.
Figure 4:
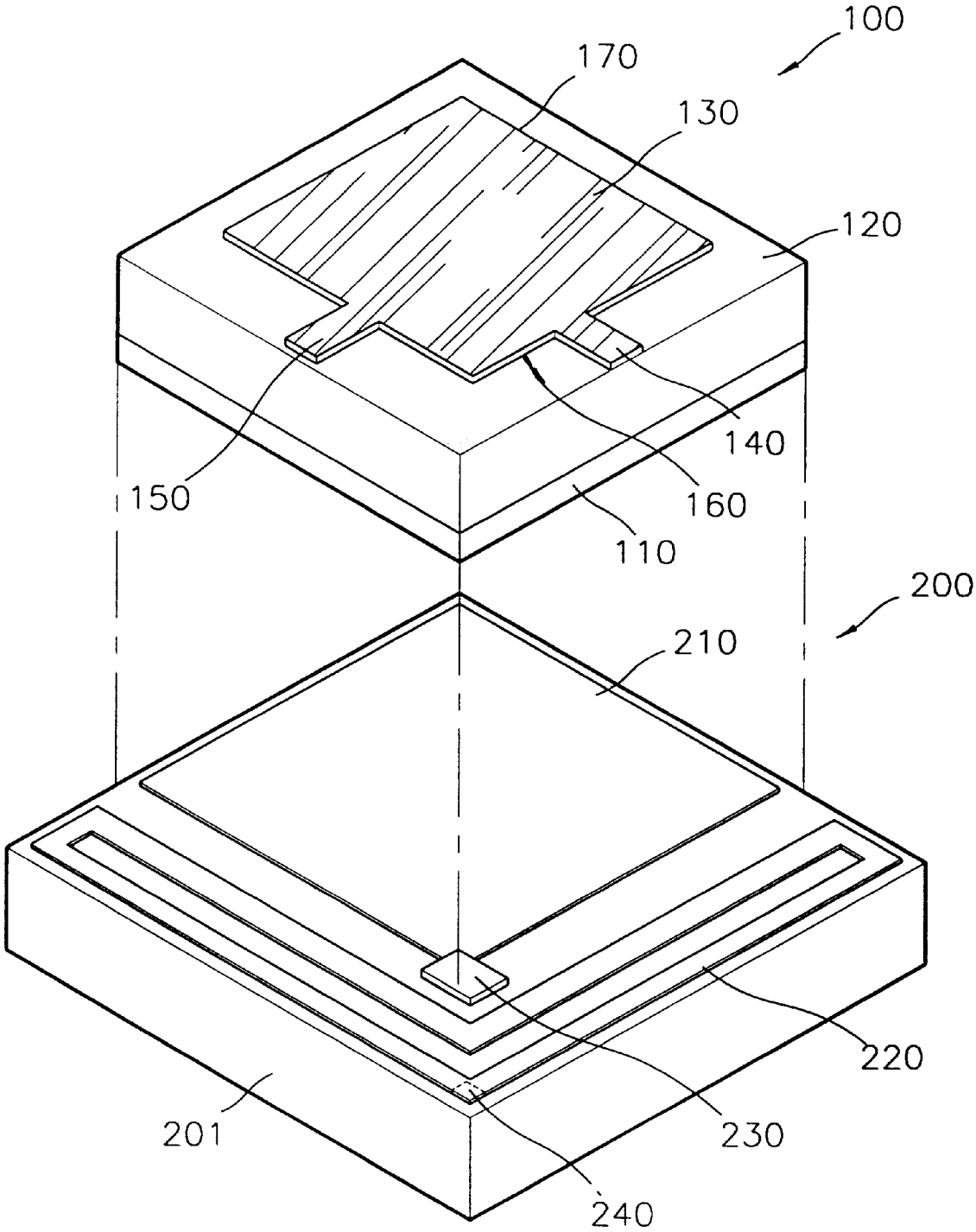
FIG. 4 is an exploded perspective view illustrating a micro-strip patch antenna for a radiotelephone transceiver according to an embodiment of the present invention.

Referring to FIG. 4, a micro-strip patch antenna for a portable and compact radiotelephone transceiver according to an embodiment of the present invention includes a dielectric ceramic module 100, and a printed circuit board (PCB) 200. The PCB 200 includes strip lines 220.

The dielectric ceramic module 100 is comprised of a first ground plate 110, a dielectric ceramic part 120, a conductive patch 130, a transmission power supply terminal 140, and a reception power supply terminal 150. The first ground plate 110, as shown in FIG. 4, is adapted to be mounted on and to contact part of the PCB 200, and functions as a ground. The dielectric ceramic part 120 is disposed on the first ground plate 110, and synchronizes frequencies. The conductive patch 130 is disposed on the dielectric ceramic part 120, and transmits and receives electromagnetic waves.

The transmission power supply terminal 140 projects from one side of the conductive patch 130 so as to supply power for transmission, and is connected to the strip lines 220 of the PCB 200. The connection between the transmission power supply terminal 140 and the strip lines 220 is omitted, for the sake of clarity, from FIG. 4.

The reception power supply terminal 150 projects from one side of the conductive patch 130 so as to supply power for reception, and is likewise connected to the strip lines 220 of the PCB 200 in a not-shown connection.

Conductive patch 130 may be understood to have a lengthwise aspect indicated by reference numeral 160, and a breadthwise aspect indicated by reference numeral 170.

In the above antenna according to the present invention, the breadthwise and lengthwise sides of the conductive patch 130 independently function as antennas. That is, the dielectric ceramic part 120 induces each side or aspect of the conductive patch 130 thereon to function as an independent antenna. That is, in the lengthwise aspect 160 of patch 130 a transmitting function is performed in which an electromagnetic wave is emitted to space by the charges supplied through the transmission power supply point 140 according to the natural frequency of the lengthwise side 160 of patch 130. The breadthwise aspect 170 of patch 130 performs a receiving function in which the breadthwise side 170 of patch 130 receives only the frequency synchronized with the natural frequency of the breadthwise aspect 170 of patch 130. That is, when electromagnetic waves traveling through space enter into the dielectric ceramic part 120, charges are generated in the breadthwise aspect 170 of patch 130 corresponding to the resonant frequency.

The PCB 200 comprises a base 201, a second ground plate 210 disposed on the base 201, strip lines 220, a ground pattern 230, and a cable connection point 240.

The second ground plate 210 is adapted to be in electrical contact with the first ground plate 110. The strip lines 220 are arranged on the base 201, and perform impedance matching between the antenna and a main board of the radiotelephone, and a one-channel dual power supply. In addition, since the power supply in a conventional radiotelephone is carried through one channel, the strip lines 220 are arranged so as to equally supply power from the one power supply source to both the transmission side and the reception side. Therefore, the strip lines 220 make it possible to install the antenna without altering the circuit of the radiotelephone, and the impedance of the antenna can be matched to 50 Ω.

To facilitate soldering between the ground pattern 230 and a ground of the radiotelephone, a portion of the ground pattern 230 is provided. Part of the s ground pattern 230 overlaps with the first ground plate 110, and the rest of ground pattern 230 leads out to the outside of the ground plates. The part that leads out is easy to solder to a ground of the radiotelephone.

The cable connection point 240 is a pad for the convenient connection of a 50 Ω cable.

When the antenna is used as an internal antenna of a 900 MHz radiotelephone, the conductive patch 130 is designed to be synchronized to 959.0125–959.9875 MHz for a transmission antenna, and to 914.0125–914.9875 MHz for a reception antenna.

The micro-strip patch antenna for a radiotelephone transceiver according to the present invention has a structure in which transmission and reception is simultaneously carried out by only one dielectric ceramic part, and two sides or aspects of the patch serve as independent antennas. In addition, this inventive antenna provides clear advantages in size and cost, in comparison with a conventional antenna using two ceramic elements for transmission and reception.

By virtue of the use of strip lines 220, which themselves perform impedance matching, there is no need to match the antenna impedance to 50 Ω in another manner, and a dual power supply can be used through one channel. Therefore, an antenna according to the present invention can be directly installed in an existing radiotelephone without modification of the circuit to provide more than one channel for power. In addition, in comparison with a conventional internal helical antenna, the antenna exhibits a high Q value, a longer communication distance, and excellent sensitivity due to selective resonance at a specific frequency.

We claim:

1. A micro-strip patch antenna for a radiotelephone transceiver, comprising:

a dielectric ceramic module for transmission and reception, comprising a first ground plate, a dielectric ceramic part disposed on the first ground plate, and a conductive patch disposed on the dielectric ceramic part and having power supply terminals; and a circuit board, comprising a base, a second ground plate disposed on the base and connected to the first ground plate, and strip lines formed on the base, adjacent to but spaced from the first ground plate, and connected to the power supply terminals.

2. The micro-strip patch antenna for a radiotelephone transceiver as claimed in claim 1, wherein the strip lines match the impedance of the antenna to that of a main circuit of the radiotelephone.

3. The micro-strip patch antenna for a radiotelephone transceiver as claimed in claim 2, wherein the matching impedance of the strip lines is 50 Ω.

4. The micro-strip patch antenna for a radiotelephone transceiver as claimed in claim 1, wherein the conductive patch is synchronized at 959.0125–959.9875 MHz for operation with one of the power supply terminals, and is synchronized at 914.0125–914.9875 MHz for operation with the other one of the power supply terminals.

5. A micro-strip patch antenna for a radiotelephone transceiver, comprising:

a dielectric ceramic module for transmission and reception, comprising a first ground plate, a dielectric ceramic part disposed on the first ground plate, and a conductive patch disposed on the dielectric ceramic part and having power supply terminals; and a circuit board, comprising a base, a second ground plate disposed on the base and connected to the first ground plate, and strip lines formed on the base, adjacent to but spaced from the first ground plate, and connected to the power supply terminals;

wherein the circuit board further includes a ground pattern, a part thereof being overlapped with the first and second ground plates, another part thereof being exposed outside of the ground plates.

6. A micro-strip patch antenna for a radiotelephone transceiver including:

a dielectric ceramic module for transmission and reception, comprising only one dielectric ceramic part, a first ground plate, the dielectric ceramic part being disposed on the first ground plate, a conductive patch disposed on the dielectric ceramic part for transmitting and receiving electromagnetic waves, a transmission power supply power terminal formed to project from one side of the conductive patch to supply power for transmission, and a reception power supply terminal formed to project from another side of the conductive patch to supply power for reception; and a circuit board, comprising a base, a second ground plate disposed on the base and connected to the first ground plate, and strip lines formed on the base, adjacent to but spaced from the first ground plate, and connected to the power supply terminals.

7. The micro-strip patch antenna for a radiotelephone transceiver as claimed in claim 6, wherein the circuit board further includes a ground pattern, a part thereof being overlapped with the first and second ground plates, another part thereof being exposed outside of the ground planes.

8. The micro-strip patch antenna for a radiotelephone transceiver as claimed in claim 6, wherein the strip lines match the impedance of the antenna to that of the main circuit of the radiotelephone.

9. The micro-strip patch antenna for a radiotelephone transceiver as claimed in claim 8, wherein the matching impedance of the strip lines is 50 Ω.

10. The micro-strip patch antenna for a radiotelephone transceiver as claimed in claim 6, wherein the conductive patch is synchronized at 959.0125–959.9875 MHZ for operation with one of the power supply terminals, and is synchronized at 914.0125–9149875 MHZ for operation with the other one of the power supply terminals.

* * * * *